US006692304B2

(12) United States Patent
Endo

(10) Patent No.: US 6,692,304 B2
(45) Date of Patent: Feb. 17, 2004

(54) SIDE SPACER STRUCTURE IN CONNECTOR

(75) Inventor: Tomomi Endo, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/261,507

(22) Filed: Oct. 2, 2002

(65) Prior Publication Data

US 2003/0068930 A1 Apr. 10, 2003

(30) Foreign Application Priority Data

Oct. 5, 2001 (JP) ..... P2001-309935

(51) Int. Cl.[7] ..... H01R 13/40
(52) U.S. Cl. ..... 439/595
(58) Field of Search ..... 439/595, 752

(56) References Cited

U.S. PATENT DOCUMENTS 5,503,573 A * 4/1996 Sagawa ..... 439/752
5,569,055 A * 10/1996 Yamanashi et al. ..... 439/752
5,618,207 A * 4/1997 Maejima ..... 439/595

* cited by examiner

*Primary Examiner*—Neil Abrams
*Assistant Examiner*—Phuong Dinh
(74) *Attorney, Agent, or Firm*—Sughrue Mion, PLLC

(57) ABSTRACT

A side spacer structure in a connector has lances respectively attached from side portions of a connector housing having a plurality of terminal receiving chambers to the connector housing and used for temporarily retaining terminals inserted into terminal receiving chambers, and securing portions for securing the terminal in a state for operation. In a position where a side spacer is temporarily retained in the connector housing, a recess portion is formed in a region of the branch plate of the side spacer inserted into the connector housing, the region facing the lower portion of the terminal receiving chamber.

2 Claims, 7 Drawing Sheets

SIDE SPACER STRUCTURE IN CONNECTOR

The present application is based on Japanese Patent Application No. 2001-309935, which is incorporated herein by reference.

BACKGROUND OF THE INVENTION

1. Field of the Invention

The present invention relates to a side spacer structure in a connector for retaining terminals respectively received into terminal receiving chambers of a connector housing and more particularly to a side spacer structure in a connector, which structure is designed to have temporary retaining members and securing members.

2. Description of Related Art

In a conventional side spacer structure in a connector, while a side spacer 1 having a plurality of branch plates 2 is temporarily retained inside a connector housing 4 having a plurality of terminal receiving chambers 5 as shown in FIG. 6, the branch plates 2 are respectively inserted into a through-hole 6 passing through the plurality of terminal receiving chambers 5. At this time, the branch plates 2 form the upper and lower walls of the terminal receiving chamber 5. Particularly, the top surface 3 of the branch plate 2 positioned beneath the terminal receiving chamber 5 forms the underside of the terminal receiving chamber 5 capable of contacting the base of a female terminal 7 when the female terminal 7 is received therein.

It is an effective means to form the walls of such a terminal receiving chamber with the side spacer in order to reduce the size of the connector housing.

However, there may be produced looseness in between the connector housing 4 and the side spacer 1 when the female terminal is inserted into the terminal receiving chamber 5. At this time, the top surface 3 of the branch plate 2 forming the underside of the terminal receiving chamber 5 shown in FIG. 7 may also enter the terminal receiving chamber 5 forcibly. In this case, the front-end lower portion of the female terminal 7 inserted from behind the terminal receiving chamber 5 comes to collide with the rear end of the branch plate 2 and the problem is that the smooth insertion of the female terminal is not carried out.

SUMMARY OF THE INVENTION

An object of the invention is to provide a side spacer structure in a connector such that a terminal is prevented from colliding with a side spacer when the terminal is inserted into a terminal receiving chamber to thereby achieve excellent terminal insertability.

In order to accomplish the object above, there is provided a side spacer structure in a connector comprising:

a connector housing having at least one of terminal receiving chambers in each of which a terminal is accommodated;

a side spacer mounted in said connector housing from a side thereof, said side spacer including an outer member having a U-shape, and a branch plate projecting from the outer member in a direction in which the side spacer is inserted to the connector housing, the branch plate including a tentative retention lance for temporarily retaining the terminal inserted into the terminal receiving chambers from a fitting side of the connector housing, and a securing portion for securing the terminal in a state for operation;

wherein a recess portion is formed on the branch plate in a region which faces to the terminal receiving chamber when the side spacer is temporarily retained in the connector housing.

In the side spacer structure in the connector thus arranged, the recess portion is formed in a region of the branch plate, the region facing to the lower side of the terminal receiving chamber in the position where the side spacer is temporarily retained in the connector housing, that is, with the terminal being fitted in. Therefore, even though shakiness is produced between the connector housing and the side spacer, part of the branch plate is never allowed to enter the terminal receiving chamber forcibly and when the terminal is inserted into the terminal receiving chamber, the terminal is prevented from colliding with the side spacer, whereby the insertability of the terminal can be improved.

Incidentally, the depth of the recess portion of the branch plate is preferably set equal to or greater than the width of the shakiness because of the vertical clearance between the connector housing and the side spacer.

DETAILED DESCRIPTION OF THE PREFERRED EMBODIMENT

Figure 1:
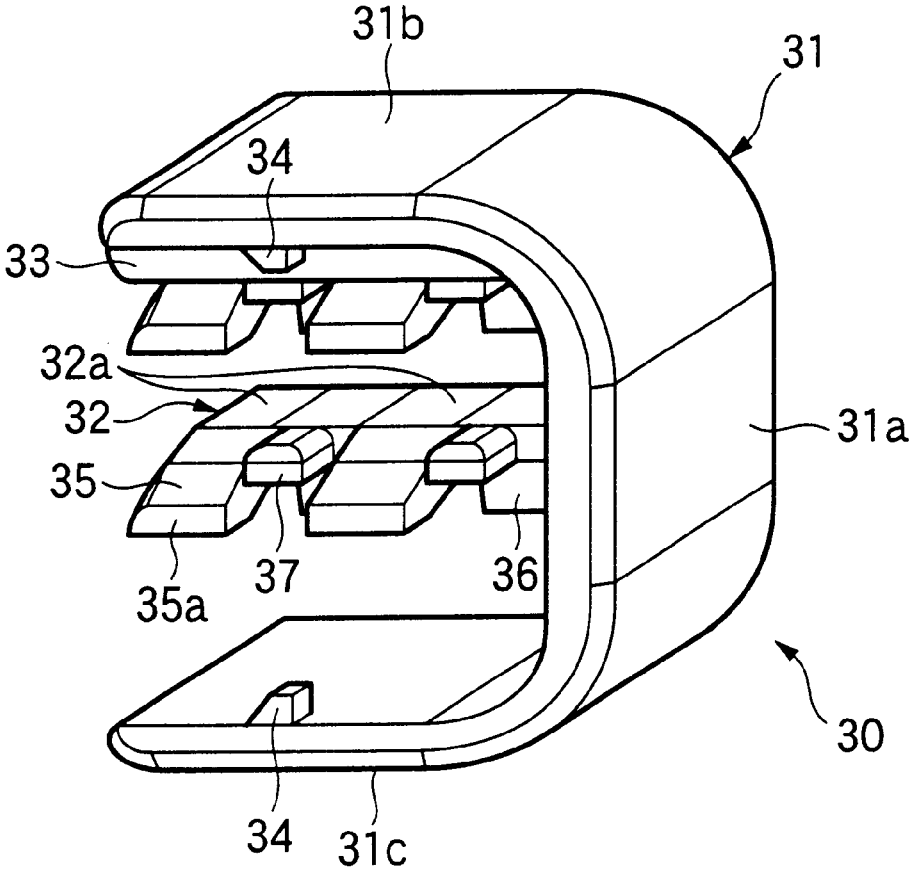
FIG. 1 is a perspective view of a side spacer structure in a connector embodying the invention.
Figure 2:
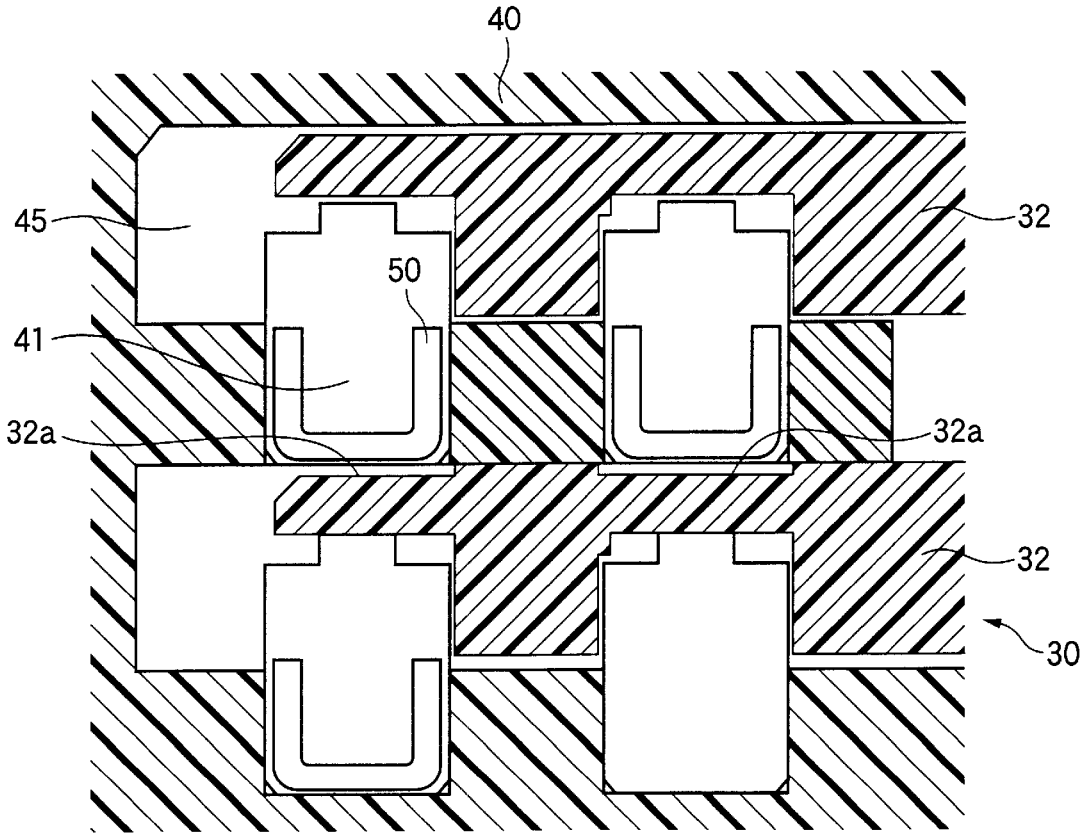
FIG. 2 is a vertical sectional view of the periphery of a terminal receiving chamber in such a condition that a side spacer of FIG. 1 is temporarily retained in a connector housing.
Figure 3:
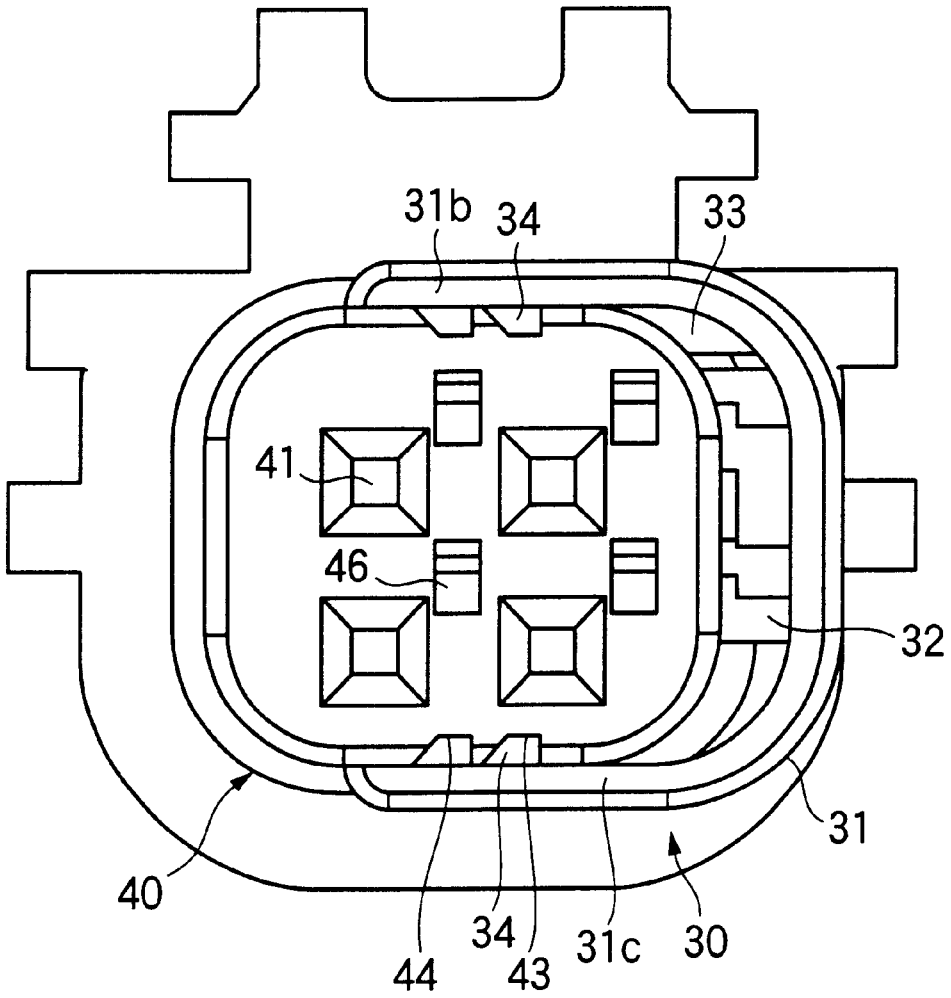
FIG. 3 is a plan view as seen from forward in FIG. 2.
Figure 4:
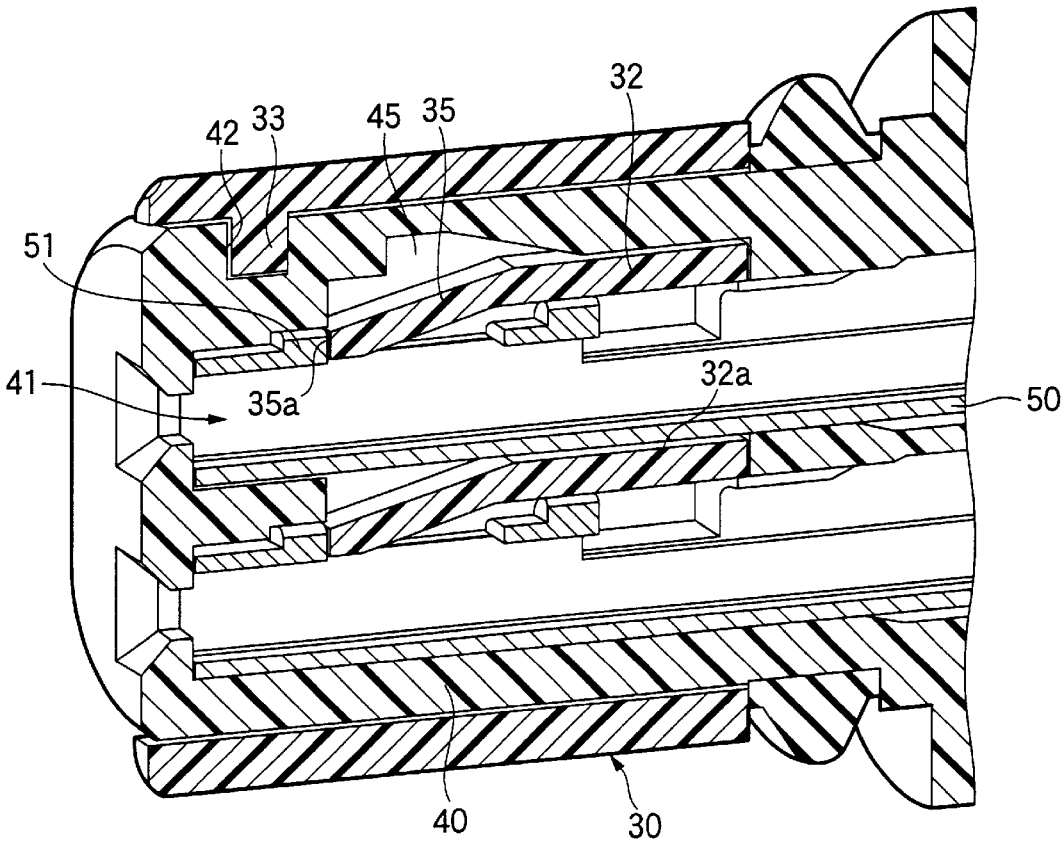
FIG. 4 is a vertical sectional view of a terminal received into the terminal receiving chamber in FIG. 3.

A description will now be given of a side spacer structure in a connector embodying the invention with reference to FIGS. 1 to 5. FIG. 1 is a perspective view of a side spacer structure in a connector embodying the invention; FIG. 2, a vertical sectional view of the periphery of a terminal receiving chamber in such a condition that a side spacer of FIG. 1 is temporarily retained in a connector housing; FIG. 3, a plan view as seen from forward in FIG. 2; FIG. 4, a vertical sectional view of a terminal received into the terminal receiving chamber in FIG. 3; and FIG. 5, a vertical sectional view of the side spacer of FIG. 4 that is completely retained inside.

As shown in FIG. 1, according to this embodiment of the invention, a side spacer 30 made of synthetic resin material comprises an outer member 31 to be mated with a housing body 40 when the outer member 31 is attached thereto which will be described later and branch plates 32 inserted into a plurality of terminal receiving chambers 41 from the side portions of the housing body 40, the branch plate 32 being projected from a side plate 31*a* to a position surrounded with the outer member 31.

The outer member 31 is a plate-like member curved in U-shape and when attached to the housing body 40, so formed that it is covered with a side plate 31*a*, an upper plate 31*b* and a lower plate 31*c*.

The branch plates 32 are projected sideways from the inside of the side plate 31*a* and respectively passed through the plurality of terminal receiving chambers 41 when attached to the housing body 40, so that a female terminal 50 can be retained inside as described later.

A guide rib 33 extending in the direction in which the side spacer 30 is attached to the housing body 40 is provided beneath the underside of the upper plate 31*b* and mates with the guide groove 42 of the housing body 40 as described later. Further, a retaining projection 34 is provided on the underside of the upper plate 31*b* and the top surface of the lower plate 31*c* both. When the retaining projections 34 are temporarily retained inside the housing body 40, the retaining projections 34 are retained in the respective temporary retaining holes 43 of the housing body 40 and when the retaining projections 34 are finally secured inside the housing body 40, the retaining projections 34 are retained in the respective final retaining holes 44 of the housing body 40 (see FIG. 3).

The branch plate 32 is projected in two parallel places of the inside of the side plate 31*a* in conformity with the position of the terminal receiving chamber 41 of the housing body 40. As shown in FIG. 1, a plurality of tentative retention lances 35 are extended forward and a plurality of securing portions 36 for securing the terminals are formed in such a manner as to correspond to the plurality of terminal receiving chambers 41. Moreover, terminal releasing lances 37 are provided in a connective arrangement in the respective side portions of the tentative retention lances 35.

As shown in FIG. 2, while the side spacer 30 is temporarily retained on the housing body 40, the branch plate 32 is inserted into a through-hole 45 laterally passing through the terminal receiving chamber 41 of the housing body 40. On the top surface of the branch plate 32, a recess portion 32*a* is formed in a portion facing the lower portion of the terminal receiving chamber. The depth of the recess portion 32*a* is set slightly greater than the vertical clearance between the through-hole 45 and the branch plate 32. Consequently, even though the branch plate 32 undergoes shakiness in the through-hole 45, the branch plate 32 is never allowed to enter the terminal receiving chamber 41 forcibly because of the shakiness.

The tentative retention lance 35 is extended forward further than the branch plate 32 with its front end tilted downward and can be subjected to elastic displacement vertically. The front 35*a* of the front end portion is a plane perpendicular to the direction into which the female terminal 50 is inserted and works to temporarily retain the female terminal 50 by coming in contact with the rear end of a temporary retaining projection 51.

The securing portion 36 for securing the terminal is provided under and integrally with the branch plate 32 and the front end of the securing portion 36 for securing the terminal forms a plane perpendicular to the direction into which the female terminal 50 is inserted. As the securing portion 36 for securing the terminal is in the form of a rectangular parallelepiped and highly rigid and used to finally secure the female terminal 50 by coming in contact with the rear end of a final retaining projection 52.

The terminal releasing lance 37 is extended forward from the branch plate 32 and formed in the way linked with the side portion of the tentative retention lance 35.

When the operation of releasing the female terminal 50 is performed, the terminal releasing lance 37 is subjected to upward elastic displacement by inserting a releasing jig (not shown) into a terminal releasing hole 46 (see FIG. 3). Thus, the tentative retention lance 35 undergoes the upward elastic displacement with the elastic displacement of the terminal releasing lance 37. Therefore, a space is provided under the terminal releasing lance 37 so that the releasing jig 60 is insertable.

As shown in FIG. 3, the guide rib 33 is mated with the guide groove 42 (see FIG. 4) when the side spacer 30 is attached to the housing body 40 and the branch plate 32 is laterally inserted into the through-hole 45 passing through the plurality of terminal receiving chambers 41 from one side portion of the housing body 40. When the pair of retaining projections 34 provided in a manner opposite to the upper plate 31*b* and the lower plate 31*c* of the outer member 31 are mated with the respective temporary retaining holes 43 formed in the upper and lower portions of the housing body 40, the side spacer 30 is temporarily retained.

When the side spacer 30 is pressed in, further, the engagement of the retaining projections 43 with the temporary retaining holes are released and the retaining projections 34 are mated with the respective final retaining holes 44 formed in the upper and lower portions of the housing body 40, so that the side spacer 40 is finally secured.

As shown in FIG. 4, while the side spacer 30 is temporarily retained, the female terminal 50 is inserted into the terminal receiving chamber 41 from behind. As the recess portion 32*a* is formed in the top surface of the branch plate 32 then, the front end of the female terminal 50 never collides with the rear end of the branch plate, whereby the female terminal 50 is smoothly received into the terminal receiving chamber 41.

The top surface of the female terminal 50 is brought into slidable contact with the tentative retention lance 35 and when the female terminal 50 is received in a predetermined position in the terminal receiving chamber 41 with the tentative retention lance 35 being bent upward, the front 35*a* of the tentative retention lance 35 comes in contact with the rear end of the temporary retaining projection 51 provided above the forward portion of the female terminal 50 so as to have the female terminal 50 temporarily retained.

Figure 5:
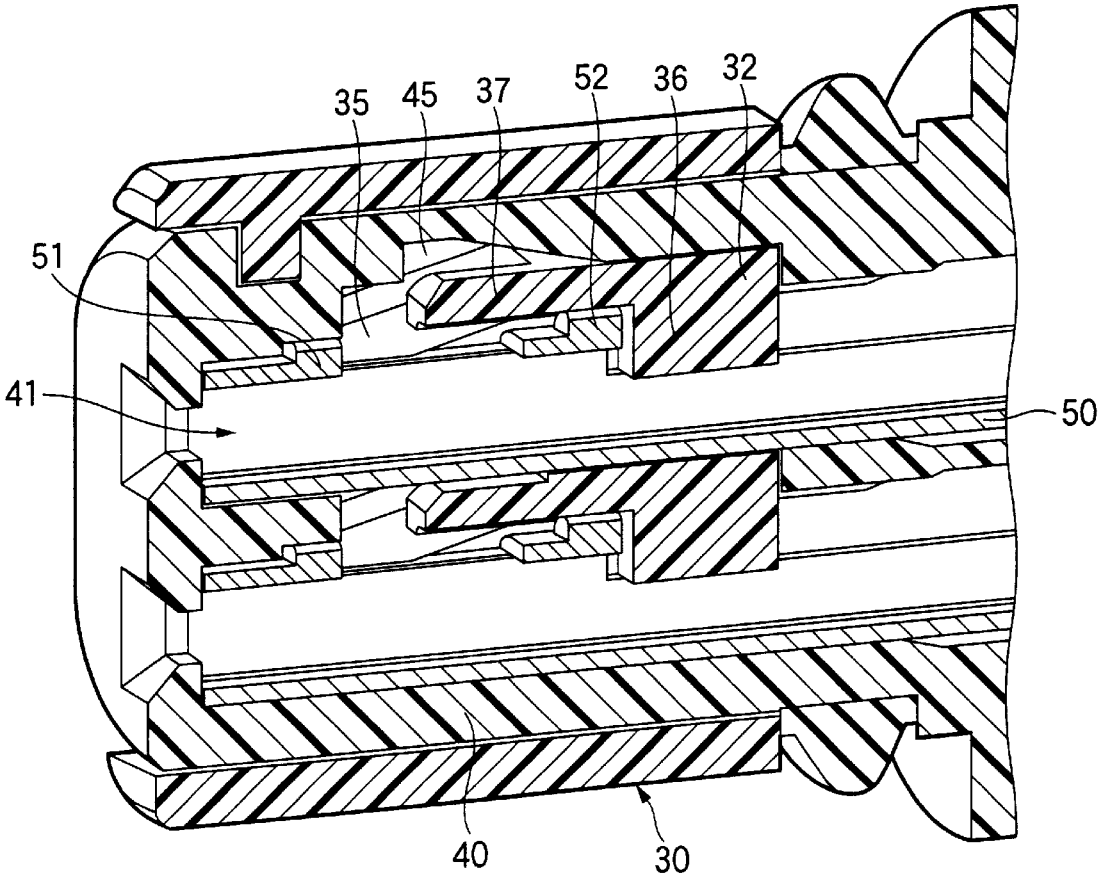
FIG. 5 is a vertical sectional view of the side spacer of FIG. 4 that is completely secured inside.
Figure 6:
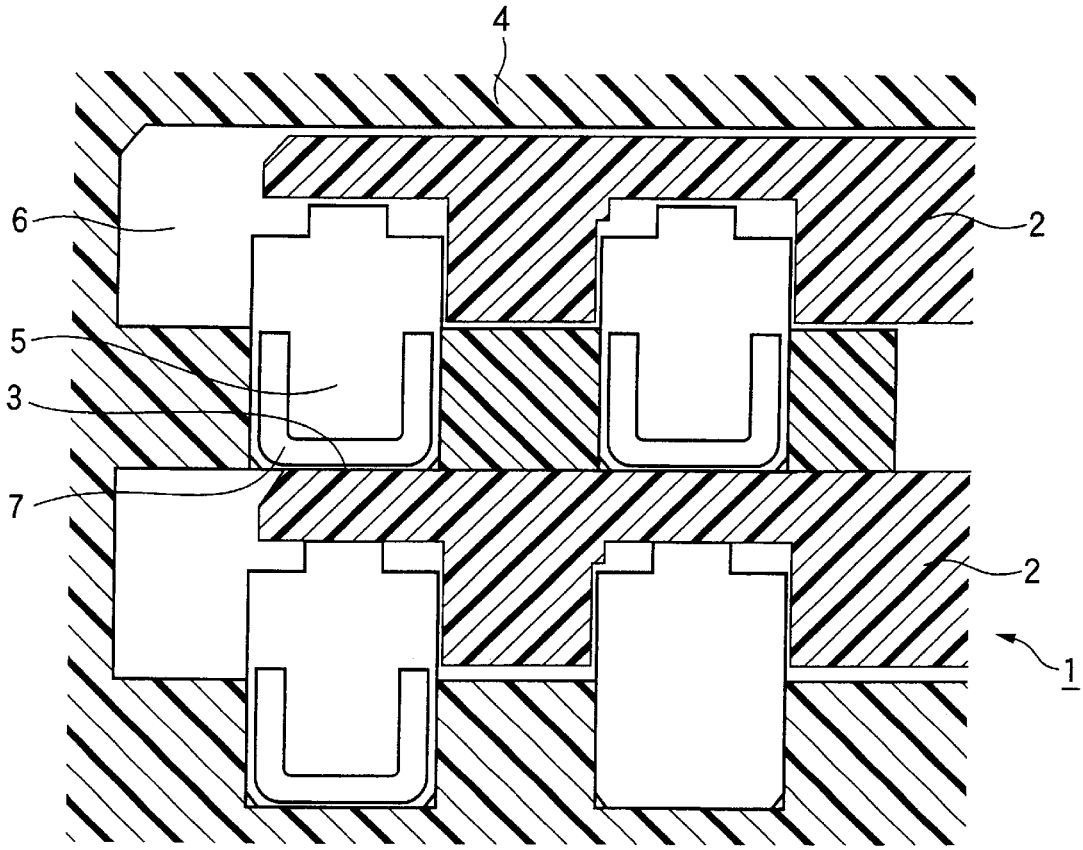
FIG. 6 is a vertical sectional view of the periphery of a terminal receiving chamber in such a condition that a conventional side spacer is retained in a side spacer.
Figure 7:
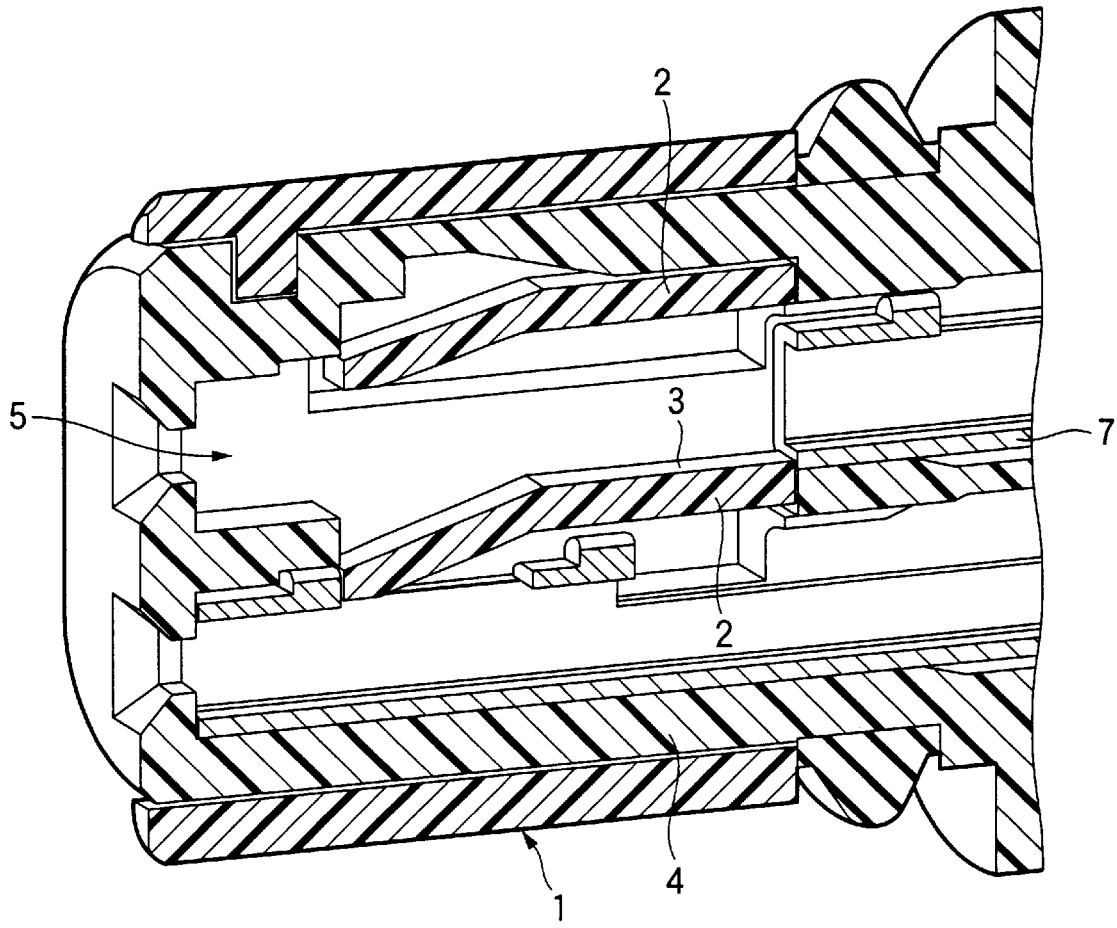
FIG. 7 is a vertical sectional view of a terminal that is inserted halfway in FIG. 6.

As shown in FIG. 5, the branch plate 32 is slidably moved deep in the through-hole 45 and the tentative retention lance 35 is released from the temporary retaining projection 51 when the side spacer 30 is finally secured and the front end of the securing portion 36 for securing the terminal comes in contact with the rear end of the final retaining projection 52 of the female terminal 50. As the securing portion 36 for securing the terminal is prevented from being removed from the final retaining projection 52 because of elastic deformation, the female terminal 50 is finally secured in the predetermined position in the terminal receiving chamber 41.

On the top surface of the branch plate 32, the recess portion 32*a* is formed in the portion facing the lower portion of the terminal receiving chamber in the side spacer structure in the connector according to this embodiment of the invention as described above. The depth of the recess portion 32*a* is set slightly greater than the vertical clearance between the through-hole 45 and the branch plate 32. Consequently, even though the branch plate 32 undergoes shakiness in the through-hole 45, the branch plate 32 is never allowed to enter the terminal receiving chamber 41 forcibly because of the shakiness. The front end of the female terminal 50 never collides with the rear end of the branch plate when the female terminal 50 is inserted into the terminal receiving chamber 41, whereby the female terminal 50 is smoothly received into the terminal receiving chamber 41.

As set forth above, in the side spacer structure in the connector thus arranged, the recess portion is formed in a region of the branch plate, the region facing the lower portion of the terminal receiving chamber in the position where the side spacer is temporarily retained in the connector housing, that is, with the terminal being fitted in. Therefore, even though shakiness is produced between the connector housing and the side spacer, part of the branch plate is never allowed to enter the terminal receiving chamber forcibly and when the terminal is inserted into the terminal receiving chamber, the terminal is prevented from colliding with the side spacer, whereby the insertability of the terminal can be improved.

What is claimed is:

1. A side spacer structure in a connector comprising:

a connector housing having at least one of terminal receiving chambers in each of which a terminal is accommodated;

a side spacer mounted in said connector housing from a side thereof, said side spacer including an outer member having a U-shape, and a branch plate projecting from said outer member in a direction in which said side spacer is inserted to said connector housing, said branch plate including a tentative retention lance for temporarily retaining the terminal inserted into said terminal receiving chambers from a fitting side of the connector housing, and a securing portion for securing the terminal in a state for operation;

wherein a recess portion is formed on the branch plate in a region which faces to the terminal receiving chamber when said side spacer is temporarily retained in the connector housing.

2. A side spacer structure according to claim 1, wherein a depth of said recess portion is get not less than a width of a vertical shakiness due to a vertical clearance between said connector housing and said side spacer.

* * * * *